US008078091B2

(12) United States Patent
Russel et al.

(10) Patent No.: US 8,078,091 B2
(45) Date of Patent: Dec. 13, 2011

(54) APPARATUS AND METHOD FOR FUSER NIP BALANCE CONTROL

(75) Inventors: Steven Matthew Russel, Bloomfield, NY (US); William Alexander Burton, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 393 days.

(21) Appl. No.: 12/370,104

(22) Filed: Feb. 12, 2009

(65) Prior Publication Data

US 2010/0202808 A1 Aug. 12, 2010

(51) Int. Cl.
*G03G 15/20* (2006.01)

(52) U.S. Cl. ..... 399/328

(58) Field of Classification Search ..... 399/328, 399/329, 330, 331, 335, 400
See application file for complete search history.

(56) References Cited

U.S. PATENT DOCUMENTS

| | | | | |
|---|---|---|---|---|
| 6,169,874 | B1 * | 1/2001 | Quesnel et al. | 399/400 |
| 6,687,468 | B2 | 2/2004 | Holubek et al. | |
| 2010/0061786 | A1 * | 3/2010 | Van Bortel et al. | 399/400 |

* cited by examiner

*Primary Examiner* — David Porta
*Assistant Examiner* — Faye Boosalis
(74) *Attorney, Agent, or Firm* — Ronald E. Prass, Jr.; Prass LLP

(57) ABSTRACT

An apparatus (100) and method (700) that controls fuser nip balance is disclosed. The apparatus can include a first fuser member (110) rotationally supported in the apparatus, a second fuser member (120) rotationally supported in the apparatus, and a rotatable cam mechanism (130) coupled to the second fuser member. The rotatable cam mechanism can be configured to provide variable pressure between the first fuser member and the second fuser member, The rotatable cam mechanism can include a cam rotational axis (135), a first cam end (131) at one end of the cam rotational axis, the first cam end including a first cam member (141) having a first cam profile perpendicular to the cam rotational axis, and a second cam end (132) at another end of the cam rotational axis, the second cam end including a second cam member (142) having a second cam profile perpendicular to the cam rotational axis, the second cam profile different from the first cam profile.

18 Claims, 5 Drawing Sheets

APPARATUS AND METHOD FOR FUSER NIP BALANCE CONTROL

BACKGROUND

Disclosed herein is an apparatus and method that controls fuser nip balance.

Presently, image output devices, such as printers, multi-function media devices, xerographic machines, ink jet printers, and other devices, produce images on media sheets, such as paper, substrates, transparencies, plastic, cardboard, or other media sheets. To produce an image, marking material, such as toner, ink jet ink, or other marking material, is applied to a media sheet to create a latent image on the media sheet. A fuser assembly then affixes or fuses the latent image to the media sheet by applying heat and/or pressure to the media sheet.

Fuser assemblies apply pressure using rotational members, such as fuser rolls or belts, that are coupled to each other at a fuser nip. Pressure is applied to the latent image on the media sheet as the media sheet is fed through the fuser nip. A single cam shaft mechanism applies force to one fuser member to generate the pressure against the other fuser member at the fuser nip. A single shaft cam mechanism, with an actuator motor and sensors for cam in and out positions, is used to load the fuser nip. In an edge registered system, pressure roll flare, used for wrinkle control, is non-symmetric across the length of the roll. Unfortunately, the pressure roll flare results in an unbalanced nip for all but the widest paper sizes. The unbalanced nip results in shortened fuser roll life and increased gloss variation on the final image.

Thus, there is a need for an apparatus and method that controls fuser nip balance.

SUMMARY

An apparatus and method that controls fuser nip is disclosed. The apparatus can include a first fuser member rotationally supported in the apparatus, a second fuser member rotationally supported in the apparatus, and a rotatable cam mechanism coupled to the second fuser member. The rotatable cam mechanism can be configured to provide variable pressure between the first fuser member and the second fuser member, The rotatable cam mechanism can include a cam rotational axis, a first cam end at one end of the cam rotational axis, the first cam end including a first cam member having a first cam profile perpendicular to the cam rotational axis, and a second cam end at another end of the cam rotational axis, the second cam end including a second cam member having a second cam profile perpendicular to the cam rotational axis, the second cam profile different from the first cam profile.

BRIEF DESCRIPTION OF THE DRAWINGS

In order to describe the manner in which advantages and features of the disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

Figure 1:
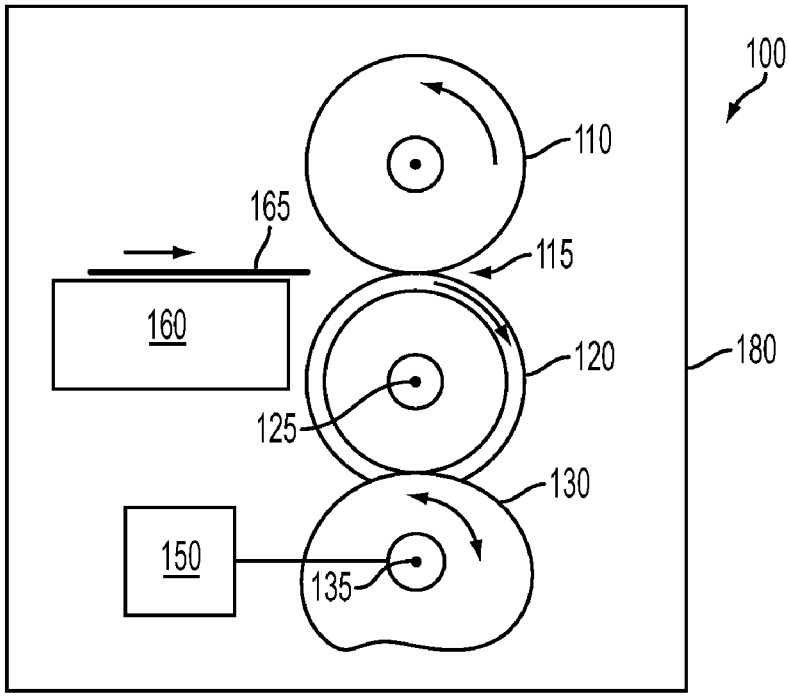
FIG. 1 is an exemplary illustration of a first view of an apparatus.

The embodiments include an apparatus for controlling fuser nip balance. The apparatus can include a first fuser member rotationally supported in the apparatus, the first fuser member configured to fuse an image on a media sheet. The apparatus can include a second fuser member rotationally supported in the apparatus and coupled to the first fuser member at a fuser nip, the second fuser member configured to fuse an image on the media sheet. The apparatus can include a rotatable cam mechanism rotationally supported in the apparatus and coupled to the second fuser member. The rotatable cam mechanism can be configured to provide variable pressure between the first fuser member and the second fuser member. The rotatable cam mechanism can include a cam rotational axis, a first cam end at one end of the cam rotational axis, and a second cam end at another end of the cam rotational axis. The first cam end can include a first cam member having a first cam profile perpendicular to the cam rotational axis. The second cam end can include a second cam member having a second cam profile perpendicular to the cam rotational axis, where the second cam profile can be different from the first cam profile.

The embodiments further include an apparatus for controlling fuser nip balance. The apparatus can include a frame and a media transport coupled to the frame, the media transport configured to transport a media sheet. The apparatus can also include a first fuser member rotationally supported in the apparatus and coupled to the frame, where the first fuser member can be configured to fuse an image on the media sheet. The apparatus can also include a second fuser member rotationally supported in the apparatus and coupled to the first fuser member at a fuser nip, where the second fuser member can be configured to fuse an image on the media sheet. The second fuser member can have a second fuser member rotational axis, a first fuser member end at a first end of the second fuser member rotational axis, and a second fuser member end at a second end of the second fuser member rotational axis. The apparatus can also include a rotatable cam mechanism rotationally supported in the apparatus and coupled to the second fuser member. The rotatable cam mechanism can be configured to provide variable amounts of pressure between the first fuser member and the second fuser member. The rotatable cam mechanism can include a cam rotational axis. The rotatable cam mechanism can also include a first cam end at one end of the cam rotational axis. The first cam end can include a first cam member having a first cam profile perpendicular to the cam rotational axis. The rotatable cam mechanism can also include a second cam end at another end of the cam rotational axis. The second cam end can include a second cam member having a second cam profile perpendicular to the cam rotational axis, where the second cam profile can be different from the first cam profile.

The embodiments further include a method of controlling fuser nip balance in an apparatus that can have a fuser assembly having a first fuser assembly end, a second fuser assembly end, a first fuser member rotationally supported in the apparatus, and a second fuser member rotationally supported in the apparatus and coupled to the first fuser member at a fuser nip. The apparatus can also have a rotatable cam mechanism rotationally supported in the apparatus and coupled to the second fuser member. The rotatable cam mechanism can include a cam rotational axis, a first cam end at one end of the cam rotational axis, the first cam end including a first cam member having a first cam profile perpendicular to the cam rotational axis, and a second cam end at another end of the cam rotational axis, the second cam end including a second cam member having a second cam profile perpendicular to the cam rotational axis, where the second cam profile can be different from the first cam profile. The method can include rotating the cam mechanism to a first position. The method can also include providing pressure between the first fuser member and the second fuser member while the cam mechanism is in the first position. The method can also include fusing an image on the media sheet. The method can also include rotating the cam mechanism to a second position. The method can also include providing similar pressure between the first fuser member and the second fuser member at the first fuser assembly end as pressure applied in the first position while the cam mechanism is in the second position. The method can also include providing different pressure between the first fuser member and the second fuser member at the second fuser assembly end from pressure applied in the first position while the cam mechanism is in the second position.

Figure 2:
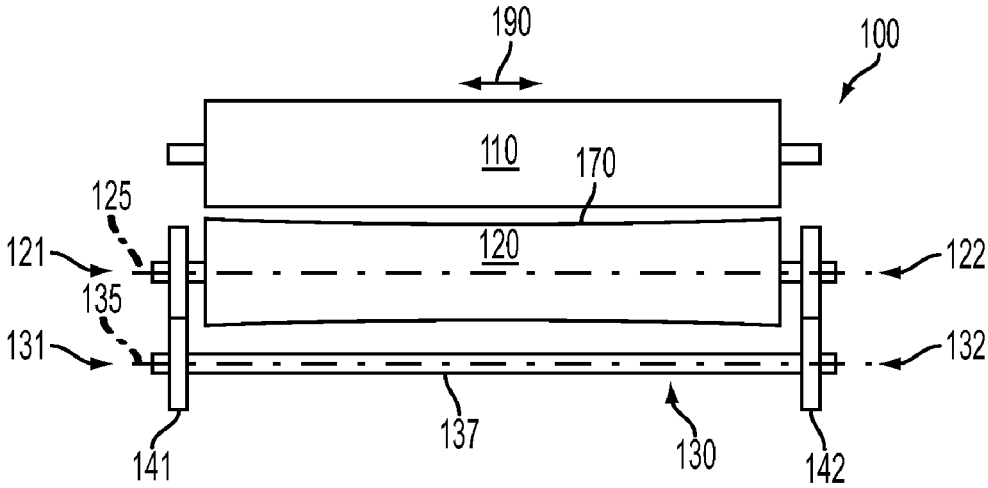
FIG. 2 is an exemplary illustration of a second view of an apparatus.

FIG. 1 is an exemplary illustration of a first view of an apparatus 100. FIG. 2 is an exemplary illustration of a second view of an apparatus 100 perpendicular to the first view. The apparatus 100 may be a printer, a multifunction media device, a xerographic machine, an ink jet machine, or any other device that generates an image on media. The apparatus 100 can include a first fuser member 110 rotationally supported in the apparatus 100, where the first fuser member 110 can be configured to fuse an image on a media sheet 165. The apparatus 100 can include a second fuser member 120 rotationally supported in the apparatus 100 and coupled to the first fuser member 110 at a fuser nip 115, where the second fuser member 120 can be configured to fuse an image on the media sheet 165. One or both of the first and second fuser members 110 and 120 can be fuser rolls, fuser belts, pressure rolls, pressure belts, or other rotational fuser members that can fuse an image on a media sheet. The first and second fuser members 110 and 120 can fuse an image on the media sheet 165 by applying pressure to the media sheet 165 at the fuser nip 115. At least one of the first and second fuser members 110 and 120 can be heated to fuse an image on the media sheet 165. At least one of the first fuser member 110 and the second fuser member 120 can have fuser member flare 170 across a length of the fuser member, which is exaggerated in the illustration.

The apparatus 100 can include a rotatable cam mechanism 130 rotationally supported in the apparatus 100 and coupled to the second fuser member 120. The rotatable cam mechanism 130 can rotate independently from the second fuser member 120. For example, one motor can rotate the rotatable cam mechanism 130 and another motor can rotate the second fuser member 120. Elements that can isolate rotation of the rotatable cam mechanism 130 from rotation of the second fuser member 120 are not shown for simplicity of illustration. The rotatable cam mechanism 130 can be configured to provide variable pressure between the first fuser member 110 and the second fuser member 120. The rotatable cam mechanism 130 can include a cam rotational axis 135. The rotatable cam mechanism 130 can include a first cam end 131 at one end of the cam rotational axis 135, where the first cam end 131 can include a first cam member 141 having a first cam profile perpendicular to the cam rotational axis 135. The rotatable cam mechanism 130 can include a second cam end 132 at another end of the cam rotational axis 135, where the second cam end 132 can include a second cam member 142 having a second cam profile perpendicular to the rotational axis 135, where the second cam profile can be different from the first cam profile. The rotatable cam mechanism 130 may be part of one of the fuser members. For example, the first cam member 141 and the second cam member 142 may be located at the ends of one of the fuser members.

The second cam profile of the second cam member 142 can be configured to provide different pressure between the first fuser member 110 and the second fuser member 120 from pressure provided by the first cam profile of the first cam member 141 between the first fuser member 110 and the second fuser member 120. The second cam profile can provide different pressure between the first fuser member 110 and the second fuser member 120 at least one section of the second cam profile from pressure provided by the first cam profile between the first fuser member 110 and the second fuser member 120. The second cam profile can also provide similar pressure between the first fuser member 110 and the second fuser member 120 at least a second section of the second cam profile to pressure provided by the first cam profile between the first fuser member 110 and the second fuser member 120.

The apparatus 100 can include a controller 150 configured to control the operations of the apparatus 100. The controller 150 can include a sensor coupled to the rotatable cam mechanism 130, where the sensor can be configured to determine positions of the first and second cam profiles as the rotatable cam mechanism 130 rotates. For example, cam location can be controlled with a home sensor and an encoder on a cam shaft. Home position can always be found reliably via the sensor and every other position can be reached by counting encoder steps from there. A load motor rotating the cam shaft can be a direct current brushless motor, a stepper motor, or any other useful device for rotating a cam shaft.

The apparatus 100 can include a registration distribution system (not shown) configured to adjust a position 190 of the fuser members 110 and 120 along a media sheet width substantially perpendicular to a media sheet travel direction. The controller 150 can include at least one fuser member position sensor configured to determine the position of the fuser members 110 and 120 along the media sheet width. The controller 150 can then adjust rotatable cam mechanism operation according to the position of the fuser members 110 and 120 along the media sheet width. For example, a registration distribution system can move an entire fuser drawer in and out by, for example, 34 mm to spread out edge wear on fuser members 110 and 120. As a result, a pressure member profile can shift in and out of balance throughout a job. The rotatable cam mechanism 130 can be stepped in and out about any given location as a function of registration distribution system location. Additional sensors can be added to the registration distribution system mechanism to provide feedback on drawer location.

The rotatable cam mechanism 130 can include a rotatable cam mechanism shaft 137 having a first shaft end at the first cam end 131 and a second shaft end at the second cam end 132, where the first cam member 141 can be coupled to the first shaft end and the second cam member 142 can be coupled to the second shaft end. Alternately, each cam member can have its own independent shaft. Two separate motors can then be used to rotate each cam member on its respective shafts.

According to a related embodiment, the apparatus 100 can include a frame 180 and a media transport 160 coupled to the frame 180, where the media transport 160 can be configured to transport a media sheet 135. The apparatus 100 can include a first fuser member 110 rotationally supported in the apparatus 100 and coupled to the frame 180, where the first fuser member 110 can be configured to fuse an image on the media sheet 165. The apparatus 100 can include a second fuser member 120 rotationally supported in the apparatus 100 and coupled to the first fuser member 110 at a fuser nip 115. The second fuser member 120 can be configured to fuse an image on the media sheet 165. The second fuser member 120 can have a second fuser member rotational axis 125, a first fuser member end 121 at a first end of the second fuser member rotational axis 125, and a second fuser member end 122 at a second end of the second fuser member rotational axis 125. The apparatus 100 can include a rotatable cam mechanism 130 rotationally supported in the apparatus 100. The rotatable cam mechanism 130 can be coupled to the second fuser member 120. The rotatable cam mechanism 130 can be configured to provide variable amounts of pressure between the first fuser member 110 and the second fuser member 120. The rotatable cam mechanism 130 can include a cam rotational axis 135. The rotatable cam mechanism 130 can include a first cam end 131 at one end of the cam rotational axis 135, where the first cam end 131 can include a first cam member 141 having a first cam profile perpendicular to the cam rotational axis 135. The rotatable cam mechanism 130 can include a second cam end 132 at another end of the cam rotational axis 135. The second cam end 132 can include a second cam member 142 having a second cam profile perpendicular to the cam rotational axis 135, where the second cam profile can be different from the first cam profile.

Figure 3:
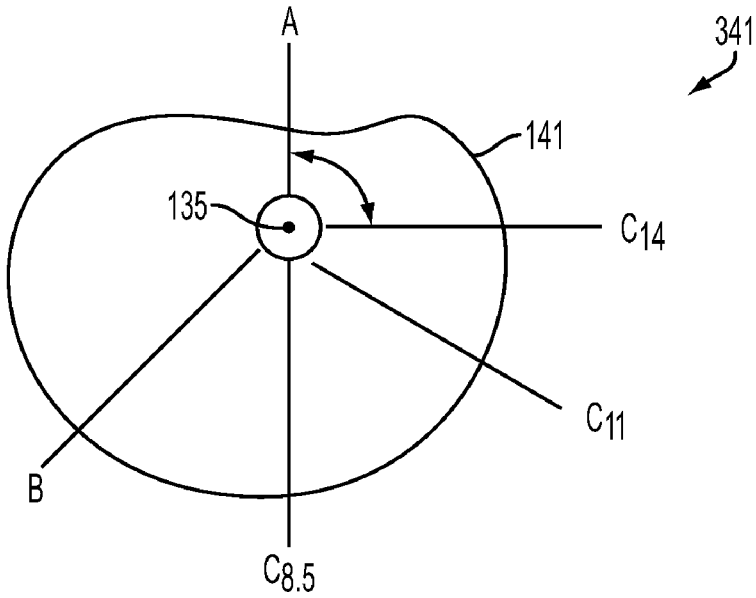
FIG. 3 is an exemplary illustration of a first cam profile of a first cam member.

FIG. 3 is an exemplary illustration of a first cam profile 341 of the first cam member 141. An uncammed position is shown by point A and the cammed in or loaded position is obtained at point B. From point B to point $C_{14}$ can be an area of constant dwell. For example, the first cam member 141 can be an outboard cam with additional cammed in positions shown at points $C_{8.5}$, $C_{11}$, and $C_{14}$ for respective media sheet sizes. With this outboard cam, there can be constant dwell for all of the cammed in positions from B through $C_{14}$.

Figure 4:
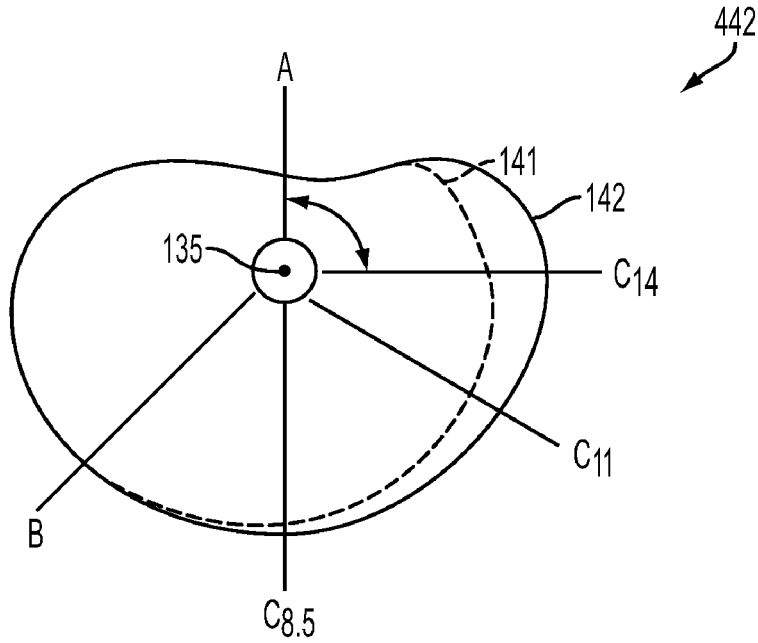
FIG. 4 is an exemplary illustration of a second cam profile of a second cam member.

FIG. 4 is an exemplary illustration of a second cam profile 442 of the second cam member 142. The second cam profile 442 can substantially match the first cam profile 341 during one portion of rotation of the rotatable cam mechanism 130. The second cam profile 442 can substantially differ from the first cam profile 341 during another portion of the rotation of the rotatable cam mechanism 130. For example, the second cam profile 442 can substantially match the first cam profile 341 during one portion of rotation of the rotatable cam mechanism 130 to provide similar pressure between the fuser members 110 and 120 at one end as at the other end of the fuser members 110 and 120. Also, the second cam profile 442 can substantially differ from the first cam profile 341 during another portion of rotation of the rotatable cam mechanism 130 to change the balance of pressure between the fuser members 110 and 120 at each end of the fuser members 110 and 120. As a further example, the second cam profile 442 can substantially match the first cam profile 341 from point A to substantially point B and even through point $C_{8.5}$. The second cam profile 442 can substantially differ from the first cam profile 341 from substantially point B through substantially point $C_{14}$.

A portion of the first cam profile 341, such as from approximately point $C_{8.5}$ or a point after point $C_{8.5}$ through point $C_{14}$, can be configured to provide constant pressure between the first fuser member 110 and the second fuser member 120 at one fuser member end. A portion of the second cam profile 442, such as from approximately point $C_{8.5}$ or a point after point $C_{8.5}$ through point $C_{14}$, can correspond to the portion of the first cam profile 341 and the portion of the second cam profile 442 can be configured to provide variable pressure between the first fuser member 110 and the second fuser member 120 at another fuser member end while the portion of the first cam profile 341 provides constant pressure between the first fuser member 110 and the second fuser member 120 at the one fuser member end. The portions can exist anywhere around the cam profiles 341 and 442. For example, the profiles 341 and 442 may be inverted from those shown and the portions and profiles 341 and 442 may vary depending on the rotation of the cam members 341 and 442, depending on algorithms used for rotation of the cam members 341 and 442, depending on desired pressure, depending on media sheet sizes and depending on other factors.

The portion of the second cam profile 442, such as from point $C_{8.5}$ or a point after point $C_{8.5}$ through point $C_{14}$, can be configured to change a width of the fuser nip 115. The portion of the second cam profile 442 can correspond to the portion of the first cam profile 341 along rotation of the cam rotational axis. The portion of the first cam profile 341 can be configured to provide a constant fuser nip width along cam positions of the portion of the first cam profile 341 and the portion of the second cam profile 442 can be configured to vary the fuser nip width along cam positions of the portions of the second cam profile 442.

For example, the second cam member 142 can be an inboard cam and the first cam member 141 can be an outboard cam that is shown with a dashed line for reference. When the second cam member 142 rotates, the nip pressure can increase steadily from point B to point $C_{14}$.

Figure 5:
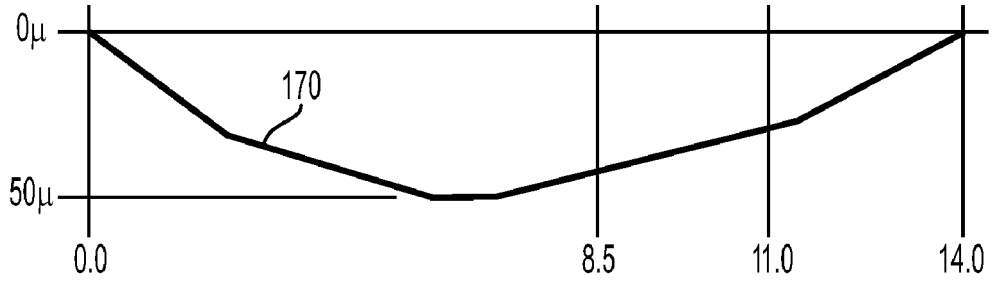
FIG. 5 is an exemplary illustration of fuser member flare.

FIG. 5 is an exemplary illustration of fuser member flare 170. The first fuser member 110 and/or the second fuser member 120 can have fuser member flare 170 across a length of the fuser member. The fuser member flare 170 can be used for media sheet wrinkle control. For example, the fuser member flare 170 can indicate that a center diameter of a rotational member is narrower than end diameters to prevent wrinkle of the media sheet 165 by stretching out the media sheet 165 from the center of the media sheet 165 to edges of the media sheet 165 passing through the fuser members. Without the employment of some embodiments, the flare 170 may not be balanced for media sheets narrower than 14 inches, which can result in an unbalanced nip across the width of a media sheet.

Figure 6:
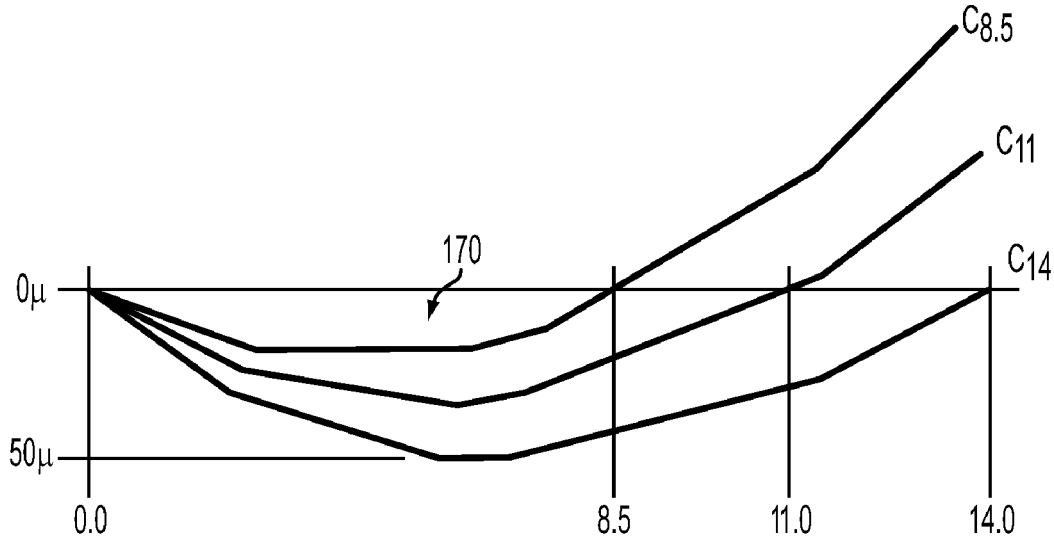
FIG. 6 is an exemplary illustration of the effect of successive nip increase.

FIG. 6 is an exemplary illustration of the effect of successive nip increase, which may be exaggerated for illustrative purposes. For every unique media sheet width, the cam location can result in a substantially perfectly balanced pressure roll flare profile and nip width. Thus, the second cam profile 442 can be configured to provide substantially balanced nip pressure for different media sheet widths, such as at ends of the widths of media sheets. When operating in the $C_{8.5}$ position, the nip at the 14" location can be larger than needed, but such may not be an issue because the 8.5" media sheet is not present past the 8.5" location. Furthermore, even though the nip width might be larger at the 14" position when running 8.5" media sheets, there is no media sheet edge there, so stress and strain drivers are absent and wear should not be accelerated. Also, since the total flare may be, for example, around 50 microns, the actual cam radial change can be relatively small in practice. Additionally, due to a relationship between nip balance and delta gloss, gloss variation can be reduced by a self balancing load system disclosed in the embodiments.

Figure 7:
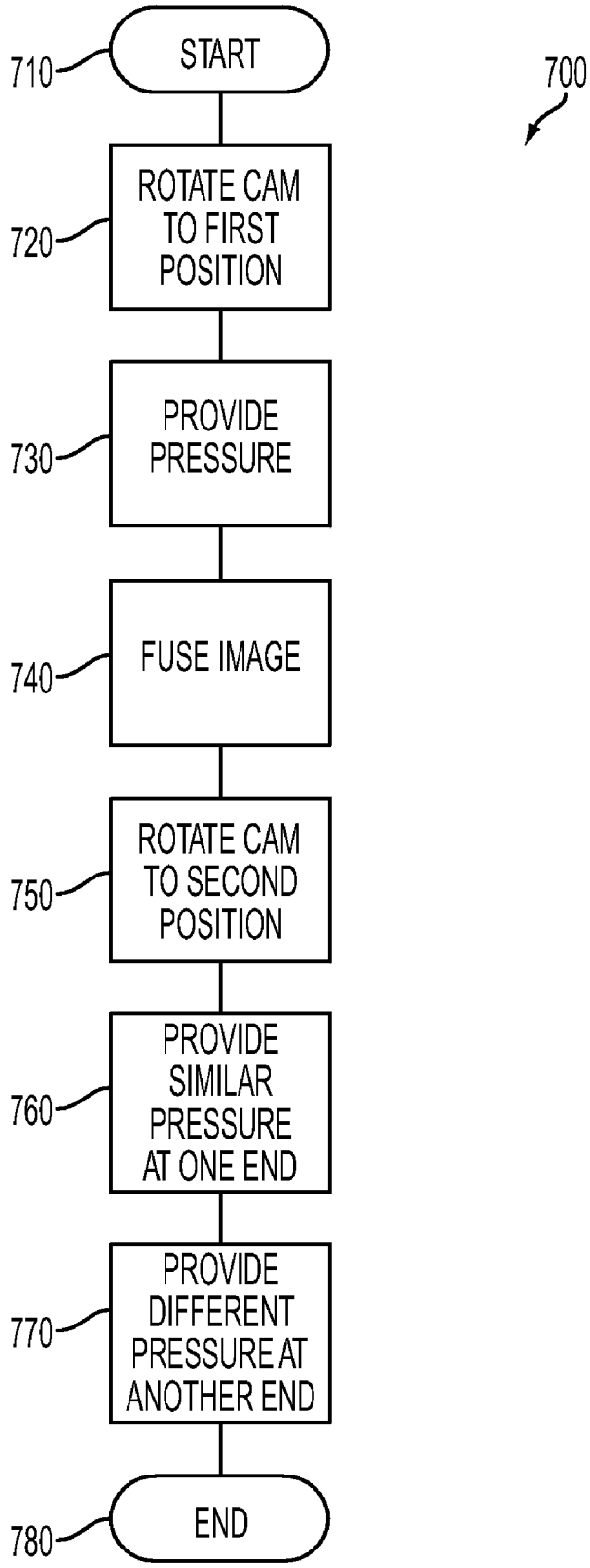
FIG. 7 illustrates an exemplary flowchart of a method.

FIG. 7 illustrates an exemplary flowchart 700 of a method in an apparatus, such as the apparatus 100, that can include a fuser assembly having a first fuser assembly end, a second fuser assembly end, a first fuser member rotationally supported in the apparatus, and a second fuser member rotationally supported in the apparatus and coupled to the first fuser member at a fuser nip. The first fuser member and the second fuser member can be configured to fuse an image on a media sheet. The apparatus can also include a rotatable cam mechanism rotationally supported in the apparatus and coupled to the second fuser member. The rotatable cam mechanism can be configured to provide variable pressure between the first fuser member and the second fuser member. The rotatable cam mechanism can include a cam rotational axis, a first cam end at one end of the cam rotational axis, and a second cam end at another end of the cam rotational axis. The first cam end can include a first cam member having a first cam profile perpendicular to the cam rotational axis. The second cam end can include a second cam member having a second cam profile perpendicular to the cam rotational axis, where the second cam profile can be different from the first cam profile. The second cam profile can substantially match the first cam profile during one portion of rotation of the rotatable cam mechanism. The second cam profile can substantially differ from the first cam profile during another portion of the rotation of the rotatable cam mechanism.

The method starts at 710. At 720, the cam mechanism is rotated to a first position. At 730, pressure is provided between the first fuser member and the second fuser member while the cam mechanism is in the first position. At 740, an image is fused on the media sheet. At 750, the cam mechanism is rotated to a second position. At 760, similar pressure is provided between the first fuser member and the second fuser member at the first fuser assembly end while the cam mechanism is in the second position as pressure applied in the first position. At 770, different pressure is applied between the first fuser member and the second fuser member at the second fuser assembly end while the cam mechanism is in the second position from pressure applied in the first position. At 780, the method ends.

Figure 8:
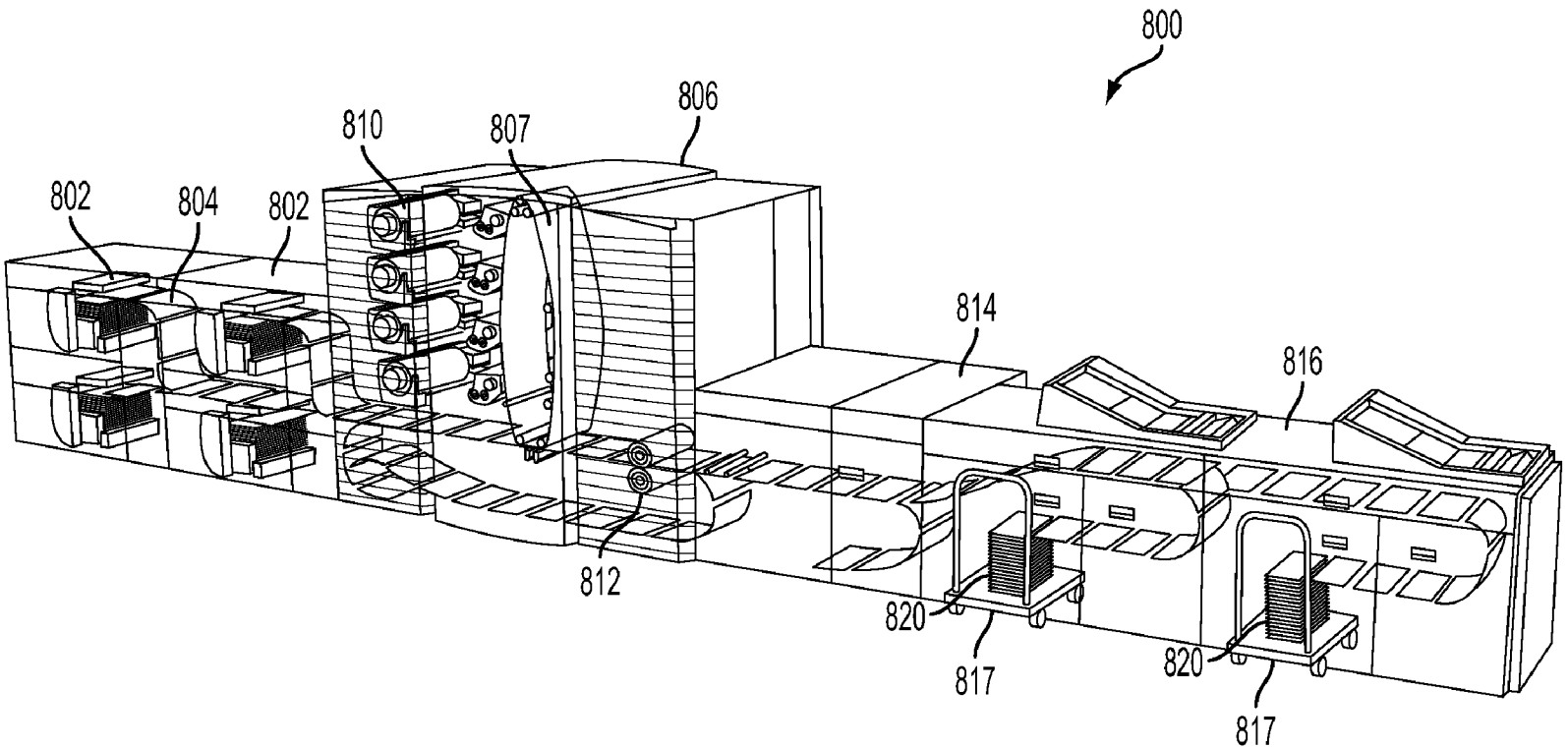
FIG. 8 illustrates an exemplary printing apparatus.

FIG. 8 illustrates an exemplary printing apparatus 800, such as the apparatus 100. As used herein, the term "printing apparatus" encompasses any apparatus, such as a digital copier, bookmaking machine, multifunction machine, and other printing devices that perform a print outputting function for any purpose. The printing apparatus 800 can be used to produce prints from various media sheets, such as coated, uncoated, previously marked, plain paper sheets, transparency sheets, or other media sheets. The media can have various sizes and weights. In some embodiments, the printing apparatus 800 can have a modular construction. As shown, the printing apparatus 800 can include at least one media feeder module 802, a printer module 806 adjacent the media feeder module 802, an inverter module 814 adjacent the printer module 806, and at least one stacker module 816 adjacent the inverter module 814.

In the printing apparatus 800, the media feeder module 802 can be adapted to feed media 804 having various sizes, widths, lengths, and weights to the printer module 806. In the printer module 806, toner or other marking material is transferred from an arrangement of developer stations 810 to a charged photoreceptor belt 807 to form images on the photoreceptor belt 807. The images are transferred to the media 804 fed through a paper path. The media 804 are advanced through a fuser 812 adapted to fuse the images on the media 804. The fuser 812 can include elements of the apparatus 100. The inverter module 814 manipulates the media 804 exiting the printer module 806 by either passing the media 804 through to the stacker module 816, or by inverting and returning the media 804 to the printer module 806. In the stacker module 816, printed media are loaded onto stacker carts 817 to form stacks 820.

Embodiments can provide for a variable inboard nip and a constant outboard nip such that an inboard to outboard balance can always be attained for any given media sheet width. Embodiments can use a single cam shaft, unique cams at the inboard and outboard ends of the cam shaft, and an encoder based rotational location sensor. The outboard cam can lift a fuser member to a nominal nip location and then produce constant dwell for the rest of its rotation. The inboard cam can reach the nominal nip location at the same point, but can continue to rise with further rotation to produce more and more inboard nip as media sheet width reduces. Cam location can be determined from media sheet attributes in a job description. Furthermore, the effect of registration distribution system motion can be filtered out by minor changes to cam position as a function of time and registration distribution system position.

Although the above description is directed toward a fuser used in xerographic printing, it will be understood that the teachings and claims herein can be applied to any treatment of marking material on a medium. For example, the marking material may comprise liquid or gel ink, and/or heat- or radiation-curable ink; and/or the medium itself may have certain requirements, such as temperature, for successful printing. The heat, pressure and other conditions required for treatment of the ink on the medium in a given embodiment may be different from those suitable for xerographic fusing.

Some embodiments may be implemented on a programmed processor. However, the embodiments may also be implemented on a general purpose or special purpose computer, a programmed microprocessor or microcontroller and peripheral integrated circuit elements, an integrated circuit, a hardware electronic or logic circuit such as a discrete element circuit, a programmable logic device, or the like. In general, any device on which resides a finite state machine capable of implementing the embodiments may be used to implement the processor functions of this disclosure.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the embodiments. For example, one of ordinary skill in the art of the embodiments would be enabled to make and use the teachings of the disclosure by simply employing the elements of the independent claims. Accordingly, the preferred embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. Also, relational terms, such as "top," "bottom," "front," "back," "horizontal," "vertical," and the like may be used solely to distinguish a spatial orientation of elements relative to each other and without necessarily implying a spatial orientation relative to any other physical coordinate system. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

We claim:

1. An apparatus comprising:

a first fuser member rotationally supported in the apparatus, the first fuser member configured to fuse an image on a media sheet;

a second fuser member rotationally supported in the apparatus and coupled to the first fuser member at a fuser nip, the second fuser member configured to fuse an image on the media sheet; and a rotatable cam mechanism rotationally supported in the apparatus, the rotatable cam mechanism coupled to the second fuser member, the rotatable cam mechanism configured to provide variable pressure between the first fuser member and the second fuser member, the rotatable cam mechanism including:

a cam rotational axis;

a first cam end at one end of the cam rotational axis, the first cam end including a first cam member having a first cam profile perpendicular to the cam rotational axis; and a second cam end at another end of the cam rotational axis, the second cam end including a second cam member having a second cam profile perpendicular to the cam rotational axis, the second cam profile different from the first cam profile, wherein a portion of the first cam profile is configured to provide constant pressure between the first fuser member and the second fuser member at one fuser member end, and wherein a portion of the second cam profile corresponds to the portion of the first cam profile and the portion of the second cam profile is configured to provide variable pressure between the first fuser member and the second fuser member at another fuser member end while the portion of the first cam profile provides constant pressure between the first fuser member and the second fuser member at the one fuser member end.

2. The apparatus according to claim 1, wherein the second cam profile is configured to provide different pressure between the first fuser member and the second fuser member from pressure provided by the first cam profile between the first fuser member and the second fuser member.

3. The apparatus according to claim 1, wherein the second cam profile substantially matches the first cam profile during one portion of rotation of the rotatable cam mechanism, and wherein the second cam profile substantially differs from the first cam profile during another portion of the rotation of the rotatable cam mechanism.

4. The apparatus according to claim 1, wherein the portion of the second cam profile is configured to change a width of the fuser nip.

5. The apparatus according to claim 1, wherein the portion of the second cam profile corresponds to the portion of the first cam profile along rotation of the cam rotational axis.

6. The apparatus according to claim 1, wherein the portion of the first cam profile is configured to provide a constant fuser nip width along cam positions of the portion of the first cam profile, and wherein the portion of the second cam profile is configured to vary the fuser nip width along cam positions of the portions of the second cam profile.

7. The apparatus according to claim 1, wherein at least one of the first fuser member and the second fuser member includes fuser member flare across a length of the fuser member, and wherein the second cam profile is configured to provide substantially balanced nip pressure for different media sheet widths.

8. The apparatus according to claim 1, further comprising a sensor coupled to the rotatable cam mechanism, the sensor configured to determine positions of the first and second cam profiles as the rotatable cam mechanism rotates.

9. The apparatus according to claim 1, further comprising:

a registration distribution system configured to adjust a position of the fuser members along a media sheet width substantially perpendicular to a media sheet travel direction; and at least one fuser member position sensor configured to determine the position of the fuser members along the media sheet width.

10. The apparatus according to claim 1, wherein the rotatable cam mechanism includes a rotatable cam mechanism shaft having a first shaft end and a second shaft end, where the first cam member is coupled to the first shaft end and the second cam member is coupled to the second shaft end.

11. An apparatus comprising:

a frame;

a media transport coupled to the frame, the media transport configured to transport a media sheet;

a first fuser member rotationally supported in the apparatus and coupled to the frame, the first fuser member configured to fuse an image on the media sheet;

a second fuser member rotationally supported in the apparatus and coupled to the first fuser member at a fuser nip, the second fuser member configured to fuse an image on the media sheet, the second fuser member having a second fuser member rotational axis, a first fuser member end at a first end of the second fuser member rotational axis, and a second fuser member end at a second end of the second fuser member rotational axis; and a rotatable cam mechanism rotationally supported in the apparatus, the rotatable cam mechanism coupled to the second fuser member, the rotatable cam mechanism configured to provide variable amounts of pressure between the first fuser member and the second fuser member, the rotatable cam mechanism including:

a cam rotational axis;

a first cam end at one end of the cam rotational axis, the first cam end including a first cam member having a first cam profile perpendicular to the cam rotational axis; and a second cam end at another end of the cam rotational axis, the second cam end including a second cam member having a second cam profile perpendicular to the cam rotational axis, the second cam profile different from the first cam profile, wherein a portion of the first cam profile is configured to provide constant pressure between the first fuser member and the second fuser member at the first fuser member end, and wherein a portion of the second cam profile corresponds to the portion of the first cam profile and the second cam profile is configured to provide variable pressure between the first fuser member and the second fuser member at the second fuser member end while the portion of the first cam profile provides constant pressure between the first fuser member and the second fuser member at the first fuser member end.

12. The apparatus according to claim 11, wherein the second cam profile is configured to provide different pressure between the first fuser member and the second fuser member at the first fuser member end from pressure provided by the first cam profile between the first fuser member and the second fuser member at the second fuser member end.

13. The apparatus according to claim 11, wherein the second cam profile substantially matches the first cam profile during one portion of rotation of the rotatable cam mechanism, and wherein the second cam profile substantially differs from the first cam profile during another portion of the rotation of the rotatable cam mechanism.

14. The apparatus according to claim 11, wherein the portion of the second cam profile is configured to change a width of the fuser nip.

15. The apparatus according to claim 11, wherein the portion of the second cam profile corresponds to the portion of the first cam profile along rotation of the cam rotational axis.

16. The apparatus according to claim 11, wherein the portion of the first cam profile is configured to provide a constant fuser nip width along cam positions of the portion of the first cam profile, and wherein the portion of the second cam profile is configured to vary the fuser nip width along cam positions of the portions of the second cam profile.

17. A method in an apparatus including a fuser assembly having a first fuser assembly end, a second fuser assembly end, a first fuser member rotationally supported in the apparatus and a second fuser member rotationally supported in the apparatus and coupled to the first fuser member at a fuser nip, the apparatus also including a rotatable cam mechanism rotationally supported in the apparatus, the rotatable cam mechanism coupled to the second fuser member, the rotatable cam mechanism including a cam rotational axis, a first cam end at one end of the cam rotational axis, the first cam end including a first cam member having a first cam profile perpendicular to the cam rotational axis, and a second cam end at another end of the cam rotational axis, the second cam end including a second cam member having a second cam profile perpendicular to the cam rotational axis, the second cam profile different from the first cam profile, the method comprising:

rotating the cam mechanism to a first position;

providing pressure between the first fuser member and the second fuser member while the cam mechanism is in the first position;

fusing an image on the media sheet;

rotating the cam mechanism to a second position;

providing similar pressure between the first fuser member and the second fuser member at the first fuser assembly end while the cam mechanism is in the second position as pressure applied in the first position; and providing different pressure between the first fuser member and the second fuser member at the second fuser assembly end while the cam mechanism is in the second position from pressure applied in the first position, wherein a portion of the first cam profile is configured to provide constant pressure between the first fuser member and the second fuser member at one fuser member end, and wherein a portion of the second cam profile corresponds to the portion of the first cam profile and the portion of the second cam profile is configured to provide variable pressure between the first fuser member and the second fuser member at another fuser member end while the portion of the first cam profile provides constant pressure between the first fuser member and the second fuser member at the one fuser member end.

18. The method according to claim 17, wherein the second cam profile substantially matches the first cam profile during one portion of rotation of the rotatable cam mechanism, and wherein the second cam profile substantially differs from the first cam profile during another portion of the rotation of the rotatable cam mechanism.

* * * * *